United States Patent [19]

Niepmann

[11] 4,322,931

[45] Apr. 6, 1982

[54] METHOD OF MANUFACTURING PACKS OF CIGARETTES AND PACK PRODUCED BY SUCH METHOD

[75] Inventor: Otto Niepmann, Gevelsberg, Fed. Rep. of Germany

[73] Assignee: Maschinenfabrik Fr. Niepmann & Co., Gevelsberg, Fed. Rep. of Germany

[21] Appl. No.: 148,310

[22] Filed: May 9, 1980

[30] Foreign Application Priority Data

May 12, 1979 [DE] Fed. Rep. of Germany ..... 2919265

[51] Int. Cl.[3] ..... B65B 11/58

[52] U.S. Cl. ..... 53/449; 53/462; 53/466; 206/273; 206/274; 206/276

[58] Field of Search ..... 53/172, 449, 462, 465, 53/466; 206/276, 274, 273

[56] References Cited

U.S. PATENT DOCUMENTS

| | | | |
|---|---|---|---|
| 2,758,520 | 8/1956 | Hepworth | 53/449 |
| 2,874,524 | 2/1959 | Ringler | 53/449 |
| 3,481,098 | 12/1969 | Sherrill et al. | 53/449 |
| 3,577,699 | 5/1971 | Silver | 53/449 |

*Primary Examiner*—Joseph Man-Fu Moy
*Attorney, Agent, or Firm*—Martin A. Farber

[57] ABSTRACT

A method of manufacturing cigarette packages from a foil wrapping which surrounds the block of cigarettes on all sides and from a printed paper wrapper, which is closed at one end by means of a bottom fold. In order to be able to work the foil covering and the wrapper on a single folding device, at least one tab is produced on the foil blank by two incisions in the region of the subsequent bottom fold and the tab is bent over approximately at right angles. Thereupon, the foil blank and the wrapper blank are brought together and connected together in such a manner that the edges of the two blanks approximately coincide on three sides while on the fourth side the foil blank protrudes beyond the wrapper blank. The interconnected blanks are folded on a folding mandrel around the long and wide sides thereof and are glued together, overlapping, on at least one long or wide side before finally the bottom fold is produced by folding the flaps onto the tab which lies against the bottom of the folding mandrel.

7 Claims, 12 Drawing Figures

METHOD OF MANUFACTURING PACKS OF CIGARETTES AND PACK PRODUCED BY SUCH METHOD

Figure 1:
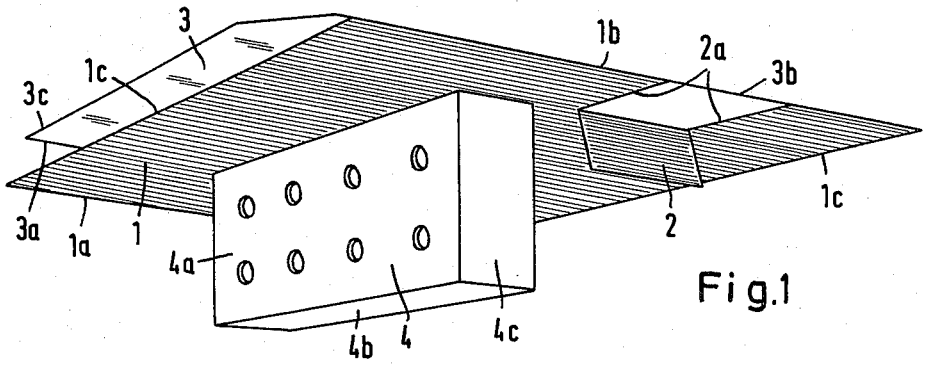

The invention relates to a method of producing packages for cigarettes from a foil wrapping which surrounds the block of cigarettes on all sides and from a printed paper wrapper which leaves one end of the foil-wrapped block of cigarettes free and is closed at the other end by a bottom folding, as well as a package of cigarettes produced by this method.

Packs of cigarettes consisting of a foil wrapping which surrounds the block of cigarettes on all sides and of a printed paper wrapper, the two of which are closed at one end of the block of cigarettes by means of a bottom fold, are known as so-called soft packs. These soft packs are surrounded on all sides by a cellophane covering which upon the opening of the pack of cigarettes is removed at that end where the pack consists exclusively of the foil wrapping. In order to remove cigarettes, the foil wrapping is only partially removed at this end so that the cigarettes remaining in the pack do not dry out too rapidly.

Two methods are known for the manufacture of these soft packs. In one method, both the foil blank and the wrapper blank are folded on separate folding devices to form an envelope which is open at one end and into which the block of cigarettes is inserted. In the other method, the foil blank is folded, by means of lateral folding, around the block of cigarettes before the block of cigarettes is then inserted into the paper envelope, which has been closed at one end by means of a bottom fold.

In both of the known methods thus two completely separate folding devices are required in order to fold the foil blank and the wrapper blank respectively, which folding devices furthermore also require conveyor devices in order to bring the folded foil blank to the folding device for the wrapper blank.

The object of the present invention is to provide a method of manufacturing cigarette packs from a foil wrapping which surrounds the block of cigarettes on all sides and from a printed paper wrapper, in which method both the foil blank and the wrapper, blank are worked into the desired cigarette pack on a single folding device so as to reduce the machinery and space necessary.

The solution provided for this purpose by the invention is characterized in the manner that at least one tab is produced by means of two incisions on the foil blank in the region of the subsequent bottom fold, this tab being bent at approximately a right angle, that the foil blank and the wrapper blank are brought together and connected with each other in the manner that the edges of the two blanks coincide approximately on three sides while on the fourth side the foil blank protrudes beyond the wrapper blank, that the interconnected blanks are fed to a parallelepiped-shaped folding mandrel, the bent tab of the foil blank covering at least a part of the bottom of the folding mandrel, that the interconnected blanks are folded around the long and wide sides of the folding mandrel and are glued together in overlapping fashion at at least one long or wide side, and that thereupon, by the folding over of the flaps which extend beyond the long sides and thereupon the flaps which extend beyond the wide sides with and then without foil onto the tab of the foil blank, which rests against the bottom of the folding mandrel, the bottom folding is effected before the pack which is open at one end, is withdrawn from the folding mandrel.

By the bringing together of the foil blank and the wrapper blank and connecting them before the folding process, the cigarette pack can be produced on a single folding device, for which purpose it is, to be sure, necessary first of all to produce the tab specified in accordance with the invention on the foil blank. This not only provides assurance that the cigarettes will be contacted solely by the foil even in the region of the bottom fold, but is also a prerequisite for effecting a proper and lasting gluing of the interconnected blanks. If this tab were not produced and bent over on the foil blank in the manner set forth in accordance with the invention, the gluing of the bottom fold could only be obtained by gluing a part of the inner foil blank to the outer side of the wrapper blank which lies below it. Since the foil, in most cases, consists of aluminum foil, a reliable gluing could not be obtained in this manner since the glue on the one hand adheres very poorly to the metal and, on the other hand, requires a very long time to set, which time is not available in view of the high speed. Cigarette packs of the type described above are produced at a speed of about 200 packs a minute so that the gluing process must be carried out within a very short period of time.

In the case of the method of the invention, a reliable gluing of the bottom fold is produced since the flap, which is free of foil due to the prior folding over of the tab of the foil blank, is glued as an outermost layer of the bottom fold onto the outside of the opposing flap so as to obtain a direct gluing between parts of the paper wrapper blank, which not only guarantees a dependable gluing but also assures a rapid gluing. Furthermore, the tab bent from the foil blank, which tab as an innermost layer on the bottom fold lies directly against the cigarettes, provides assurance that these cigarettes will not be able to come into contact with parts of the wrapper blank nor with glue. Despite a considerable reduction of the amount of machinery and of the spacial requirements of the method in accordance with this invention thus retains the advantages of the known methods.

In accordance with another feature of the invention, the bent tab of the foil blank is produced by two incisions which extend parallel to each other and at right angles to the edge so as to produce a relatively large tab which covers a large portion of the surface of the end of the block of cigarettes.

In a preferred embodiment of the invention, the tab is formed on a place of the foil blank (which later forms the central part which remains free of folds) of a bottom flap which is hinged on one wide side of the pack of cigarettes. In accordance with a further development of the invention, two tabs can also be formed on the foil blank, these tabs overlapping on the bottom of the folding mandrel with these two tabs being preferably opposite each other.

In order, on the one hand, to avoid a visible protrusion of the foil blank at the edges of the finished cigarette package and on the other hand to obtain a reliable gluing of the longitudinal edges of the wrapper blank to each other, it is finally proposed, as a further development of the method of the invention, that the foil blank and the wrapper blank be so brought together and connected with each other that, on the edges forming the subsequent overlapping of the interconnected blanks on a long or wide side, the foil blank protrudes beyond the wrapper blank on the inner layer while the wrapper blank protrudes beyond the foil blank on the outer layer. The foil blank which protrudes beyond the wrapper blank on the inner layer dependably prevents contact between the cigarettes and the wrapper blank while the wrapper blank which protrudes beyond the foil blank on the outer layer can be dependably glued to the wrapper blank of the inner layer, without any parts of the foil blank being visible.

The cigarette pack manufactured by the method of the invention is characterized by the fact that the bottom fold is formed by at least one tab of the foil blank, which tab forms the innermost layer, and by flaps of the long and wide sides, which flaps engage one above the other, the flap, which is free of foil as a result of the bent-off tab, constitutes an outermost layer being glued on its inner side to the outside of the opposite flap.

Two illustrative embodiments of the method of the invention are shown in the drawing on the basis of successive method steps:

FIGS. 1 to 8 show perspective views of an embodiment of the method of the invention based on eight method steps, and FIGS. 9 to 12 show perspective views of a second embodiment of the method on the basis of the first four method steps.

The perspective views show in FIG. 1 a foil blank 1 which, exept for a tab 2 which is bent off at approximately a right angle, is arranged on the inside of a wrapper blank 3 and connected to the latter, preferably by gluing. The foil blanked which consists, for instance, of an aluminum-backed foil has a front edge 1*a* which protrudes beyond the front edge 3*a* of the wrapper blank 3, while the rear edges 1*b* and 3*b* of the blanks 1 and 3 coincide approximately. Nor is there coincidence with respect to the side edges 1*c* and 3*c* of the blanks 1 and 3 respectively. While the side edge 1*c* of the foil blank 1, which edge forms the subsequent inner layer, protrudes beyond the corresponding side edge 3*c* of the wrapper blank 5, the side edge 3*c* of the wrapper blank 3, which edge subsequently forms the outer layer, extends beyond the corresponding side edge 1*c* of the foil blank 1.

Before the blanks 1 and 3 are brought together and glued to each other, the tab 2, which can be clearly noted in FIG. 1, is produced on the rear edge 1*b* of the foil blank 1 by means of two incisions 2*a*, the tab being bent downward at right angles to the surface of the foil blank 1. In the embodiment shown, the two incisions 2*a* extend parallel to each other and at right angles to the rear edge 1*b* of the foil blank 1, so that a rectangular tab 2 is formed.

Figure 2:
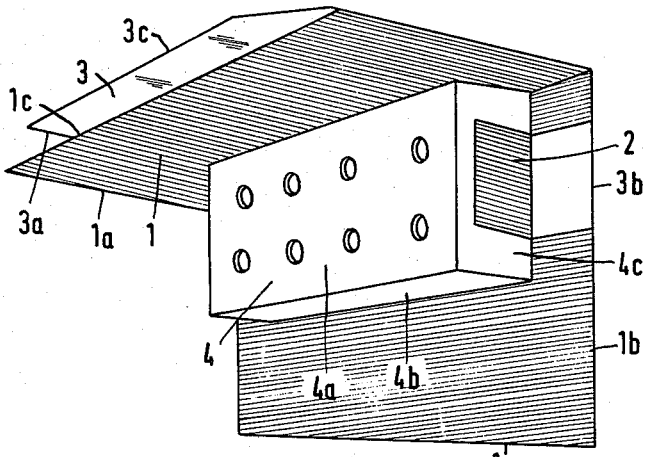

The interconnected blanks 1 and 3 with the tab 2 bent at approximately a right angle are fed to a folding mandrel of a folding device (not otherwise shown) in such a manner that the fold edge of the tab 2 extends approximately parallel to one edge of the parallelepiped-shaped folding mandrel 4, which is formed by wide sides 4*a*, long sides 4*b*, a bottom 4*c* and a top (not visible). In the embodiment shown in FIGS. 1 to 8, the interconnected blanks 1 and 3 are first of all brought, as shown in FIG. 1, against one long side 4*b* of the folding mandrel 4 before the part of the blanks 1 and 3 bearing the tab 2 is folded, as shown in FIG. 2, against a (not visible in the drawings) wide side 4*a* of the folding mandrel 4. Thereupon, as shown in FIG. 3, the downward extending part of the blanks 1 and 3 is folded with the foil blanks against the bottom long side 4*b* of the folding mandrel 4, whereupon the balance thereof, as shown in FIG. 4, is folded against the front wide side 4*a* of the folding mandrel 4.

Figure 3:
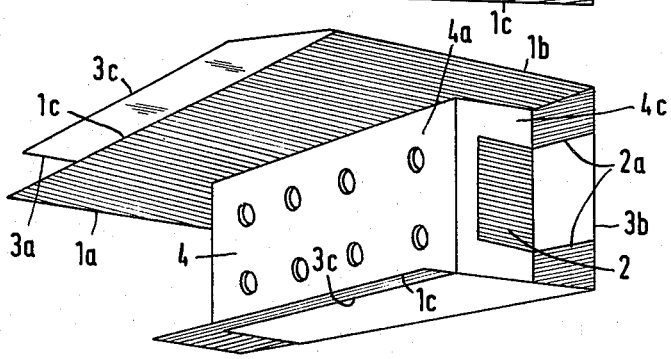
Figure 4:
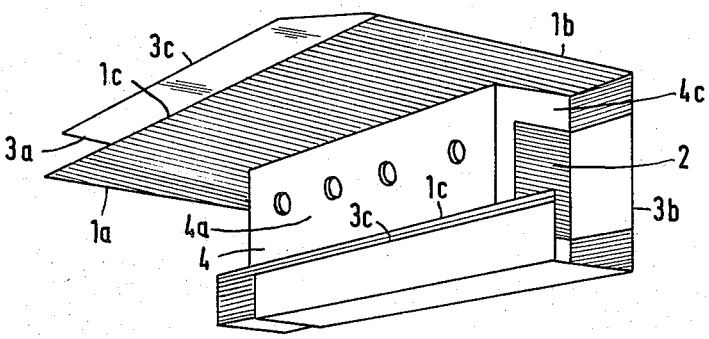
Figure 5:
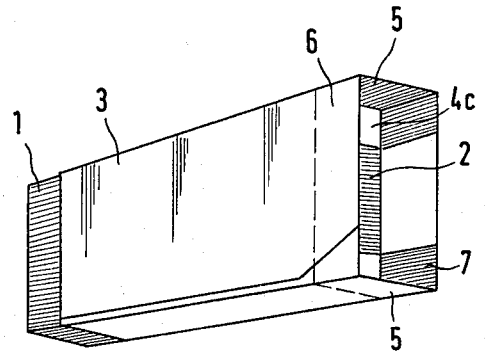

FIGS. 3 and 4 show that in the case of this part of the interconnected blanks 1 and 3, the side edge 1*c* of the foil blank 1 protrudes beyond the side edge 3*c* of the sleeve blank 3. In this way assurance is had that when the other end of the blanks 1 and 3 is thereupon folded down no part of the wrapper blank 3 can come into contact with the wide side 4*a* of the folding mandrel 4. In order to assure a good attachment of the side edges 1*c* and 3*c* of the blanks 1 and 3, which edges overlap as shown in FIG. 5, the side edge 3*c* of the wrapper blank 3 protrudes in the outer layer beyond the parallel-extending side edge 1*c* of the foil blank 1. This type of overlapping provides assurance that the gluing of this side fold is effected directly between parts of the wrapper blank 3. Since this wrapper blank 3 consists of paper, a dependable and rapid gluing is thereby obtained.

Figure 6:
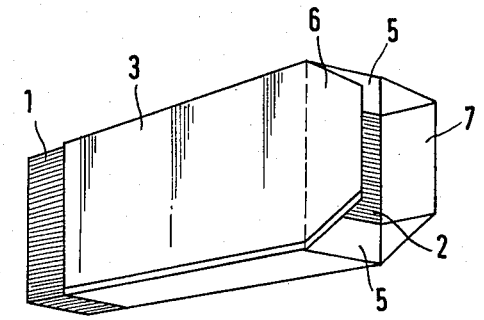
Figure 7:
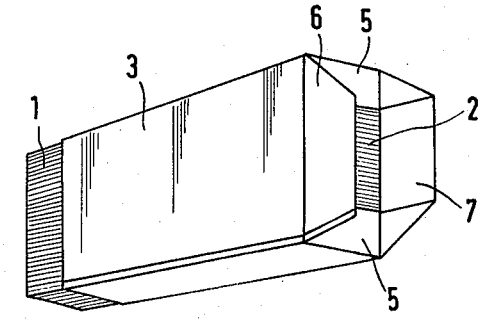
Figure 8:
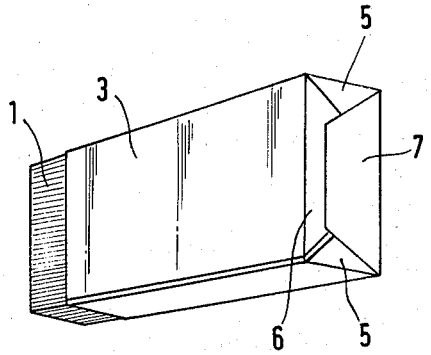
Figure 9:
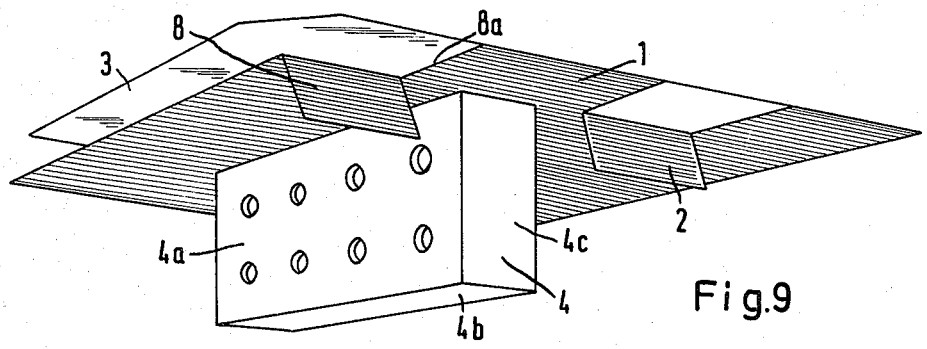
Figure 10:
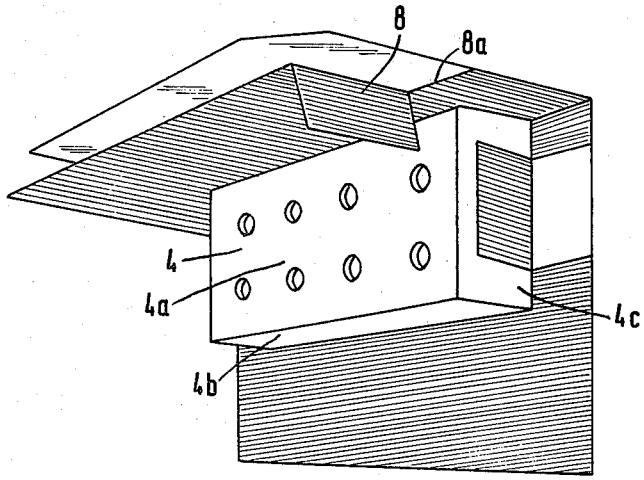
Figure 11:
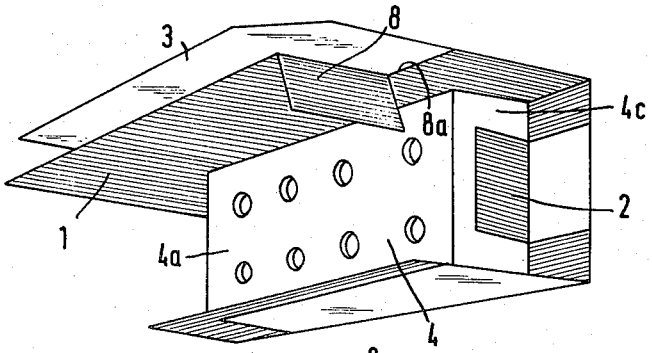

After the process steps described above in accordance with FIGS. 1 to 5, the folding mandrel 4 carries a tubular envelope formed of the interconnected blanks 1 and 3, the foil blank 1 definitely protruding beyond the wrapper blank 3 at the top end of the folding mandrel 4, as can be noted in FIG. 5. That end remains open for the introduction of the cigarettes which are combined to form a block of cigarettes, while the other end of the tubular envelope is closed by means of a bottom fold the production of which is shown in FIGS. 6 to 8. This bottom fold is formed by folding flaps 5 which protrude beyond the long sides 4*b* of the folding mandrel 4 as well as the flaps 6 and 7 which protrude beyond the wide sides 4*a* of the folding mandrel 4, as shown in FIG. 5.

In order to prevent contact of the cigarettes in the region of the bottom fold of the cigarette pack with parts of the wrapper blank 3, the innermost layer of the bottom fold is formed by the flap 2 which was already applied against the bottom 4*c* of the folding mandrel 4 in the method step in accordance with FIG. 2. According to FIG. 6, the flaps 5 are now folded against the bottom 4*c* of the folding mandrel 4 before according to FIG. 7 the flap 6 which is connected on the inside with the foil blank 1 is folded down. Finally, the flap 7 is folded down, which flap does not contain any foil blank 1 on its inner side as a result of the previous bending off of the tab 2. In this way assurance is had that a gluing of the bottom fold between the outside of the flap 6 and the inside of the flap 7 takes place directly between parts of the wrapper blank 3 of paper so that the bottom fold can also be rapidly and dependably glued. FIG. 8 shows the completely folded cigarette pack with the bottom fold produced and the other end open. After the introduction of the cigarettes, the open end is closed by folding over the parts of the foil blank 1 which protrude from the wrapper blank 3, this closure being, for instance, again effected by means of a so-called bottom fold.

Although with the embodiment of the method which has been described above it is already practically impossible for parts of the wrapper blank 3 which are not provided with the foil blank 1 to come into contact directly with the cigarettes in the region of the bottom fold, in case of the inaccurate bringing together of the blanks 1 and 3 in the region of the rear edges 1*b* and 3*b* it may happen that narrow strips of the wrapper blank 3 outside of the region of the flap 2 form the inner layer of the bottom fold. In order to avoid this, the foil blank 1 can be provided with a second tab 8 (FIGS. 9–12) which is developed parallel to the first tab 2 by means of an incision 8*a* on a corner which is formed by the rear edge 1*b* and the side edge 1*c* and which is bent off at right angles to the surface of the foil blank 1 in the same manner as the first tab 2.

Figure 12:
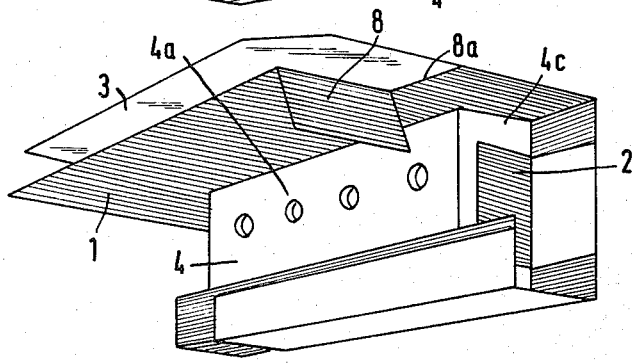

In the case also of the second embodiment of the method, which is shown in FIGS. 9 to 12, the folding is effected in accordance with the method steps described above with reference to FIGS. 1 to 4. The difference is merely that, as shown in FIG. 12, when the interconnected blanks 1 and 3 are folded against the front wide side 4*a* of the mandrel 4 the second tab 8 also is folded against the bottom 4*c* of the folding mandrel 4, the tab 8 partially covering the first tab 2. This second tab 8 in this way provides assurance that there will not remain uncovered on the bottom 4*c* of the folding mandrel 4 any region on which parts of the wrapper blank 3 can form the innermost layer of the bottom fold due to any irregularities upon the bringing together of the blanks 1 and 3. The folding steps for the production of the bottom fold after the method steps of FIG. 12 corresponding to the method steps shown in FIGS. 5 to 8 so that they need not be described again.

I claim:

1. A method of manufacturing a cigarette package from a foil wrapping which surrounds a block of cigarettes on all sides and from a printed paper wrapper, which leaves one end of the foil-wrapped block of cigarettes free and which is closed by a bottom fold at its other end, comprising the steps of cutting at least one tab on a foil blank by two incisions in the region of the bottom fold to be subsequently produced, bending the tab off approximately at right angles to the foil blank, bringing the foil blank and a wrapper blank of substantially the same size together and connecting said blanks to each other in a manner such that corresponding edges of the two blanks coincide approximately on three of the corresponding edges and that said foil blank projects beyond said wrapper blank on a fourth edge, feeding said connected blanks to a parallelpiped-shaped folding mandrel with the foil blank against the mandrel and in a position projecting beyond the long or wide sides of the folding mandrel and positioning the bent tab of the foil blank so as to cover at least a part of a smaller, bottom side of the folding mandrel, folding the connected blanks around the long and wide sides of the folding mandrel so as to form long overlapping portions on at least one long or wide side of the folding mandrel, gluing the overlapping portions at the at least one long or wide side, at said other end folding narrow flaps (which constitute portions of both said foil blank and said wrapper blank which project beyond the long sides of the mandrel) in a direction toward the bottom side of the mandrel and then, folding a first wide flap, which projects beyond a wide side of the mandrel opposite to an exposed projecting portion of the wrapper blank from which the tab has been bent-off, in a direction toward said tab, and then folding a bottom flap which includes said exposed projecting portion of the wrapper blank against the last mentioned flap, said tab thereby lying on the bottom side of the folding mandrel, thereby producing the bottom fold and the cigarette package which is open at said one end, withdrawing the cigarette package from the folding mandrel via said one end.

2. The method according to claim 1, wherein said bent tab of the foil blank is produced by said two incisions which extend parallel to each other at right angles to one of the edges of the blanks.

3. The method according to claim 1, further comprising positioning said tab by said cutting and folding steps at a place of the foil blank which place forms a central part, which remains free of folds, of said bottom flap which is hinged to a wide side of the cigarette package.

4. The method according to claim 1, comprising cutting two said tabs on said foil blank, folding said tabs on one another partially overlapping on the bottom side of the folding mandrel during said first-mentioned folding step.

5. The method as set forth in claim 4, wherein a second of said two tabs is formed by one incision adjacent a corner of said foil blank between two adjacent of the edges of the foil blank.

6. The method according to claim 1 further comprising the steps of overlapping the blanks in said bringing and connecting step such that said foil blank projects beyond the wrapper blank on one long edge of the blanks, and the wrapper blank projects beyond the foil blank on the other long edge of the blanks, performing the first-mentioned folding step so that the one long edge of the blanks with the foil blank projecting beyond the wrapper blank lies against the mandrel constituting an inner layer of the overlapping portions on the at least one long or wide side and so that the other long edge of the blanks with the wrapper blank projecting beyond the foil blank lies against the inner layer and constitutes an outer layer of the overlapping portions on the long or wide side of the blanks.

7. A cigarette package produced by a method of manufacturing a cigarette package from a foil wrapping which surrounds a block of cigarettes on all sides and from a printed paper wrapper, which leaves one end of the foil-wrapped block of cigarettes free and which is closed by a bottom fold at its other end, comprising the steps of cutting at least one tab on a foil blank by two incisions in the region of the bottom fold to be subsequently produced, bending the tab off approximately at right angles to the foil blank, bringing the foil blank and a wrapper blank of substantially the same size together and connecting said blanks to each other in a manner such that corresponding edges of the two blanks coincide approximately on three of the corresponding edges and that said foil blank projects beyond said wrapper blank on a fourth edge, feeding said connected blanks to a parallelpiped-shaped folding mandrel with the foil blank against the mandrel and in a position projecting beyond the long or wide sides of the folding mandrel and positioning the bent tab of the foil blank so as to cover at least a part of a smaller, bottom side of the folding mandrel, folding the connected blanks around the long and wide sides of the folding mandrel so as to form long overlapping portions on at least one long or wide side of the folding mandrel, gluing the overlapping portions at the at least one long or wide side, at said other end folding narrow flaps (which constitute portions of both said foil blank and said wrapper blank which project beyond the long sides of the mandrel) in a direction toward the bottom side of the mandrel and then, folding a first wide flap, which projects beyond a wide side of the mandrel opposite to an exposed projecting portion of the wrapper blank from which the tab has been bent-off, in a direction toward said tab, and then folding a bottom flap which includes said exposed projecting portion of the wrapper blank against the last mentioned flap, said tab thereby lying on the bottom side of the folding mandrel, thereby producing the bottom fold and the cigarette package which is open at said one end, withdrawing the cigarette package from the folding mandrel via said one end, comprising the foil wrapping which surrounds the block of cigarettes on all sides and of the printed paper wrapper, both of which are closed at the other end of the block of cigarettes by the bottom fold, wherein said bottom fold is formed by said at least one tab of the foil blank, said tab forms an innermost layer of the package, and by said flaps, engaging over each other, of the long and wide sides, said exposed projecting portion of said wrapper blank, constituting an outermost layer and a portion of said bottom flap which is free of foil as a result of the bent-off tab, is glued on an inner side thereof to the outside of the opposite said first wide flap.

* * * * *